US010494164B2

(12) United States Patent
Nickerson et al.

(10) Patent No.: US 10,494,164 B2
(45) Date of Patent: Dec. 3, 2019

(54) DISPENSABLE CONTAINMENT VESSEL AND DISPENSING SYSTEM

(71) Applicant: Phoenix Closures, Inc., Naperville, IL (US)

(72) Inventors: Darren Nickerson, Naperville, IL (US); Thomas Stoneberg, Buffalo Grove, IL (US); Len Ekkert, Lemont, IL (US)

(73) Assignee: Fifth Third Bank, an Ohio Banking, Westmont, IL (US)

( * ) Notice: Subject to any disclaimer, the term of this patent is extended or adjusted under 35 U.S.C. 154(b) by 580 days.

(21) Appl. No.: 15/065,270

(22) Filed: Mar. 9, 2016

(65) Prior Publication Data

US 2017/0259982 A1 Sep. 14, 2017

(51) Int. Cl.
*B65D 81/32* (2006.01)
*B65D 51/28* (2006.01)

(52) U.S. Cl.
CPC ..... *B65D 81/3211* (2013.01); *B65D 51/2835* (2013.01)

(58) Field of Classification Search
CPC ..... B65D 81/3211; B65D 81/32; B65D 81/3222; B65D 51/285; B65D 51/2835; B65D 51/28; B65D 23/04; B65D 35/242; B65D 83/687; B65D 85/804; B65D 2217/00
USPC ..... 206/222, 219
See application file for complete search history.

(56) References Cited

U.S. PATENT DOCUMENTS 3,451,540 A * 6/1969 Kulischenko ..... A61C 5/66 206/220
3,993,245 A 11/1976 Smith
4,195,632 A 4/1980 Parker et al.
4,434,905 A 3/1984 Ou et al.
(Continued)

FOREIGN PATENT DOCUMENTS

WO 2008096261 8/2008

OTHER PUBLICATIONS

Eurasian Patent Office Patent Search Report regarding Eurasian regional application No. 201790329/26, dated Jul. 11, 2017 (4 pgs.).
(Continued)

*Primary Examiner* — Robert Poon
(74) *Attorney, Agent, or Firm* — Husch Blackwell LLP

(57) ABSTRACT

A dispensing system provides for the delivery of a contained substance sealed in a Dispensable Containment Vessel (DCV) into a target container, which can contain another substance. The dispensing system includes a dispensing adaptor (Dispensing System) that couples the DCV to the target container so substances can be transferred between the containers without escaping or contacting the user. When the DCV is activated from a secure conformation into a dispensing conformation, the dispensing adaptor sealably engages the target container and portions of the dispensing adaptor place stress on a barrier, which frangibly tears along defined tearing paths to form vents or flaps that are forced apart against the dispensing adaptor, allowing the contents of the DCV to enter the target container. The dispensing conformation also facilitates the efficient mixture of substances and allows them to travel between the containers to flush residual DCV contents into the target container.

22 Claims, 11 Drawing Sheets

(56) References Cited

U.S. PATENT DOCUMENTS

| | | | | |
|---|---|---|---|---|
| 4,693,366 | A | 9/1987 | Goncalves | |
| 4,782,985 | A | 11/1988 | Kinsley | |
| 4,887,747 | A | 12/1989 | Ostrowsky et al. | |
| 5,005,737 | A | 4/1991 | Rohr | |
| 5,169,035 | A | 12/1992 | Imbery, Jr. | |
| 5,271,531 | A | 12/1993 | Rohr et al. | |
| 5,439,143 | A | 8/1995 | Brown et al. | |
| 5,743,443 | A | 4/1998 | Hins | |
| 5,927,566 | A | 7/1999 | Mueller | |
| 5,934,514 | A | 8/1999 | Lampe et al. | |
| 5,944,234 | A | 8/1999 | Lampe et al. | |
| 5,954,237 | A | 9/1999 | Lampe et al. | |
| 5,971,232 | A | 10/1999 | Rohr et al. | |
| 6,045,004 | A | 4/2000 | Elliott | |
| 6,112,951 | A | 9/2000 | Mueller | |
| 6,152,296 | A | 11/2000 | Shih | |
| 6,616,016 | B2 | 9/2003 | Hicks et al. | |
| 6,672,487 | B1 | 1/2004 | Lohrman | |
| 6,688,501 | B2 | 2/2004 | DeGroot et al. | |
| 6,749,092 | B2 | 6/2004 | Olechowski et al. | |
| 6,786,363 | B1 | 9/2004 | Lohrman | |
| 6,935,493 | B2 | 8/2005 | Cho | |
| 6,935,543 | B2 | 8/2005 | DeGroot et al. | |
| 6,948,643 | B1 | 9/2005 | Lohrman | |
| 6,951,295 | B1 | 10/2005 | Gaus et al. | |
| 7,089,964 | B1 | 8/2006 | Collins et al. | |
| 7,117,654 | B2 | 10/2006 | Danks | |
| 7,255,250 | B2 | 8/2007 | Pugne | |
| 7,464,834 | B2 | 12/2008 | Law et al. | |
| 7,503,469 | B2 | 3/2009 | Bloom et al. | |
| 7,506,782 | B2 * | 3/2009 | Walters | B65D 51/2835 206/219 |
| 7,510,676 | B2 | 3/2009 | Eimer | |
| 7,628,297 | B2 | 12/2009 | Pugne | |
| 7,731,042 | B2 | 6/2010 | Blomdahl et al. | |
| 7,896,155 | B2 * | 3/2011 | Seelhofer | B65D 51/2835 206/219 |
| 7,980,430 | B2 | 7/2011 | Hickok et al. | |
| 8,276,748 | B2 | 10/2012 | Nyambi et al. | |
| 8,365,933 | B2 | 2/2013 | Jäckel | |
| 8,413,830 | B2 | 4/2013 | Guglielmini | |
| 8,443,970 | B2 | 5/2013 | Coon | |
| 8,534,509 | B2 | 9/2013 | Duquet | |
| 8,544,690 | B2 | 10/2013 | Garcia et al. | |
| 8,550,270 | B2 | 10/2013 | Jäckel | |
| 8,684,615 | B2 | 4/2014 | Lecoutre | |
| 9,833,799 | B2 | 12/2017 | Minnette et al. | |
| 2004/0173488 | A1 | 9/2004 | Griffin et al. | |
| 2006/0016475 | A1 | 1/2006 | Hirota | |
| 2006/0037975 | A1 | 2/2006 | Suffa | |
| 2006/0138179 | A1 | 6/2006 | Suffa | |
| 2009/0236339 | A1 | 9/2009 | Blomdahl | |
| 2012/0080450 | A1 | 4/2012 | Dziersk et al. | |
| 2013/0306642 | A1 * | 11/2013 | Dabah | B65D 51/28 220/521 |
| 2014/0209644 | A1 | 7/2014 | Socier et al. | |
| 2015/0014369 | A1 | 1/2015 | Hatton et al. | |
| 2015/0166239 | A1 * | 6/2015 | Dabah | B65D 51/28 206/222 |
| 2015/0251837 | A1 | 9/2015 | Krammer | |

OTHER PUBLICATIONS

European Search Report EP 17157154.0.

* cited by examiner

DISPENSABLE CONTAINMENT VESSEL AND DISPENSING SYSTEM

FIELD OF THE INVENTION

The present invention relates generally to systems for selectively dispensing the flow of a contained substance between an interior environment and an exterior environment, such as, for example, for dispensing a product from one container into another container without contact to the user.

BACKGROUND OF THE INVENTION

Many dispensing systems deliver contained substances to target containers. In some cases, the delivery to an empty target container is desired; in other cases, it is desirable to add a contained substance to another substance in a target container. Some compositions are made from substances that degrade or generate undesirable by-products after they are combined. There is a need for a dispensing system that allows the mixture of substances at a desired time and place.

There also exists a need for a dispensing system that delivers a compound from one container to another while preventing contact between the contained substance and the user. There may be a need for a dispensing system that protects its user from toxic, caustic, volatile, or abrasive substances, or protects the substances from contamination by the user or the external environment.

Dispensing closures may be used for dispensing a wide variety of substances such as liquids, suspensions and other substances into containers as known by those skilled in the art. For example, pressure-actuated, flexible valves have been used to dispense contained substances. However, these dispensing closures are poorly suited for many applications, as they may deliver only limited quantities of a contained substance or require repeated manipulation for complete delivery. Some dispensing closures includes slits that allow the movement of substances, such as liquids, only while pressure is applied by the user to keep the slits open. Once the pressure is removed, the slits reseal and the flow of the contained substance is interrupted. There is a need for quick, consistent, and efficient dispensers of a contained substance that do not require repeated manipulations of the dispensers.

Some dispensing closures require users to use squeezing or pushing motions to release contained substances from the enclosed container, through the closure, which may require a degree of manual strength or dexterity some users lack. Some users may find these dispensing closures and containers difficult to grip or manipulate or control. It is also known to be desirable for a dispensing system to be capable of single use and deliver a predefined measure or dose of a contained substance. Single use capability guards against counterfeiting and provides tamper evidence. Other dispensing systems may require users to engage unpredictable amounts of force for successful use. It may be preferable for some users to have a dispensing system that operates by a rotational movement. It may be even more preferable for a dispenser system that provides delivery of the contained substance after minimal manipulation of the dispensing system. Use of a Dispensable Containment Vessel (DCV) is most preferred.

The contents of such a Dispensable Containment Vessel (DCV) may be released, in a controlled fashion, by engagement of a rotational movement, rather than by squeezing or pushing motions, but some users may lack the manual strength to dispense stored composition. A rotational movement may require less manual strength and less guessing of how much force to apply. It may be desirable for a dispensing system that operates with a rotational movement. It would also be advantageous to provide delivery of the contained substance after limited manipulation of the DCV.

There is also a need for a dispenser that allows a reversible flow of substances between the DCV and the target container, thus allowing the DCV to be flushed after the initial delivery of a contained material and ensuring the delivery of residual materials not initially delivered. There is a need for a DCV that ensures a more complete and thorough delivery of a contained substance and enables the specific mixture of two or more substances as they are ultimately delivered to the target container.

There also exists a need for a dispensing system that delivers compounds from one container to another and allow a reversible flow of substances while preventing contact between the user and the substances involved in the dispensing process, either to protect the user from toxic, caustic, volatile, or abrasive substances, or to protect the substances from contamination by the user or the external environment. Protection may be required relating either to the contained substance or to the final mixture of substances, if any, or both.

It is also known that some compositions must be made by the sequential addition of multiple components, sometimes in a particular order or at particular times or in particular ratios. There is a need for employing multiple DCVs to deliver multiple different substances in succession in separate steps, at particular times, or in certain sequences, to enable the making of such compositions.

BRIEF SUMMARY OF THE INVENTION

This invention provides an improved dispensing system for dispensing contained substances, including flow able materials such as liquids or fine particles. The invention is embodied as a Dispensable Containment Vessel (DCV) and Dispensing Systems for use with a variety of containers in which a contained substance may be contained.

The dispensing system generally includes a DCV and a dispensing adaptor (dispensing means), and is mountable to a target container, which may be empty or may contain some substance prior to engagement of the dispensing system.

The DCV may include a frangible barrier that secures the contained substance to be dispensed, as well as a connecting portion for sealably communicating with the dispensing adaptor.

The dispensing adaptor may include a connecting portion that sealably connects it to the DCV, providing a sealable connection between the DCV and the target container and facilitating the transfer of the contained substance. The dispensing adaptor can also sealably mount the dispensing system to the target container so that the contents of the DCV can be transferred from the DCV through an aperture of the dispensing adaptor into the target container.

When initially engaged with the target container, the dispensing system adopts a secure conformation in which the contained substance remains stored in the DCV. In the secure conformation, the contents of the target container, if any, can also be protected against leakage and spillage, as well as premature mixture with the contained substance.

When the dispensing system is activated into a dispensing configuration, a central portion and spaced-apart wings of the dispensing adaptor apply force against the frangible barrier of the DCV, and the barrier tears along tearing paths of relatively lesser thickness or greatness weakness. When force is applied, the tearing paths may generate flaps in the frangible barrier that separate to form spaces between them, or may generate vents in the frangible barrier, through which the contents of the DCV may flow. The spaces between the flaps, or the vents, may increase in size when the frangible barrier is forced against the spaced-apart wing of the dispensing adaptor, allowing greater flow of the contained substances.

After the dispensing system is activated into a dispensing conformation, the dispensing system remains sealably connected to the target container, but the contained substance is released from the DCV to reversibly flow into the target container. The reversible flow feature allows a user to flush residual amounts for thorough delivery of the contained substance from the DCV after the initial delivery. After use, the dispensing system can be removed from the target container.

These and other features and advantages of the present invention will be apparent from the following detailed description, claims, and accompanying drawings.

DETAILED DESCRIPTION OF THE PREFERRED EMBODIMENTS

Figure 1A:
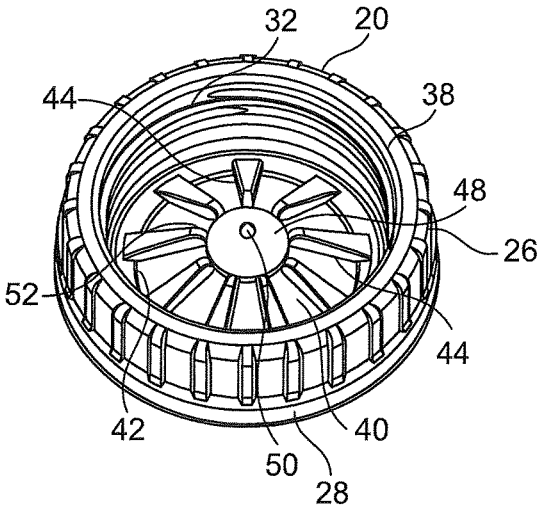
FIGS. 1A-1C shows an external view of a dispensing adaptor, a DCV, and a dispensing adaptor mounted on an exemplary target container.
Figure 1B:
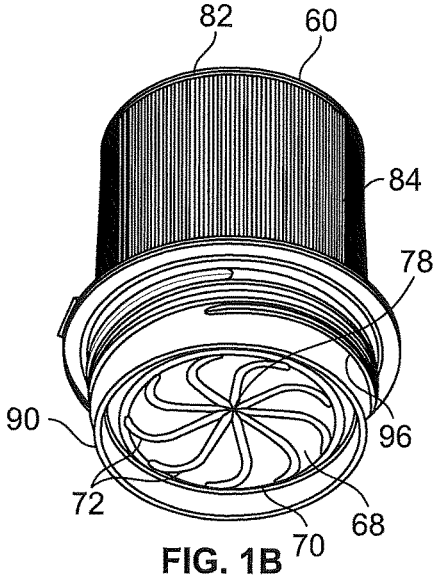
Figure 1C:
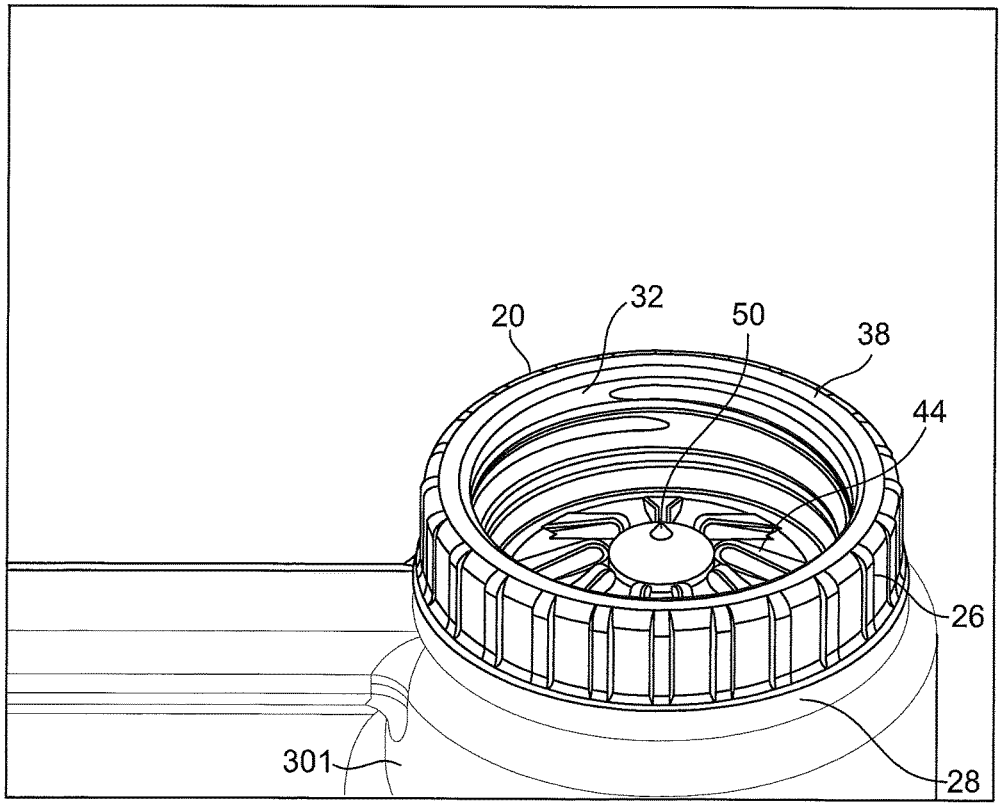
Figure 2A:
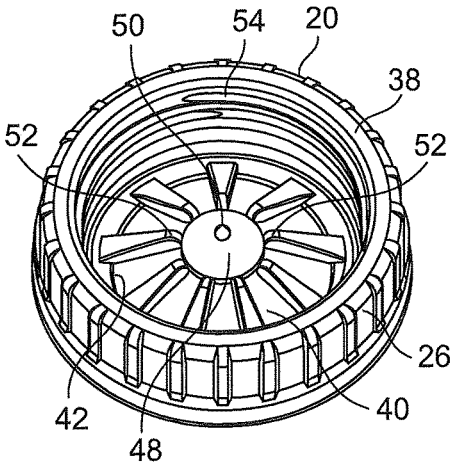
FIGS. 2A-2E shows an external view of a dispensing adaptor, a DCV, and a dispensing system mounted on an exemplary target container, and a cross-sectional view of a DCV with contained substance and a planned exploded view of an embodiment of the invention.
Figure 2B:
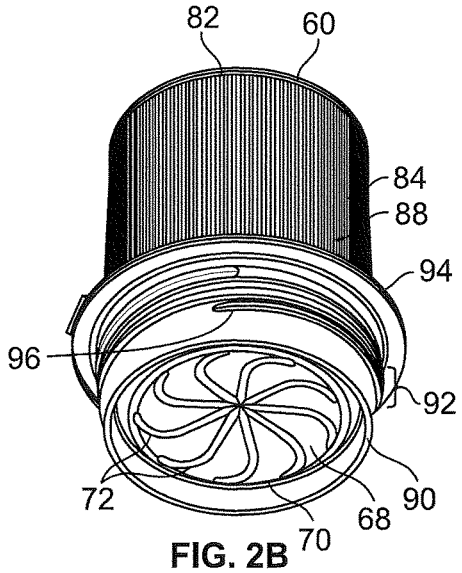
Figure 2C:
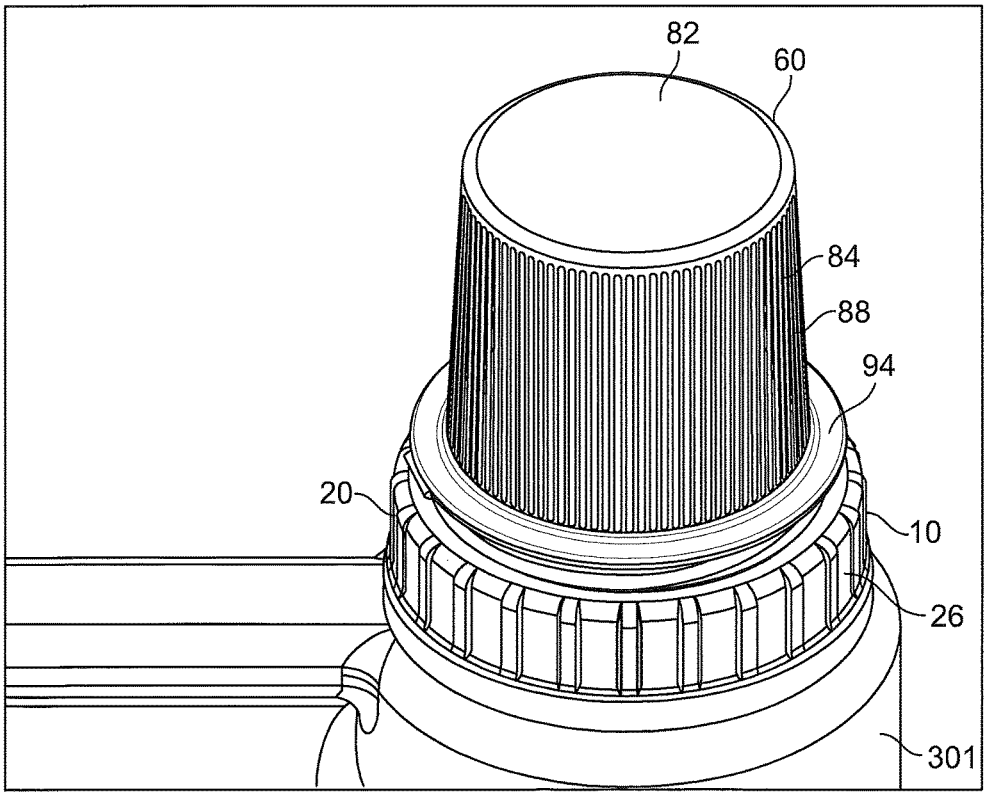
Figure 2D:
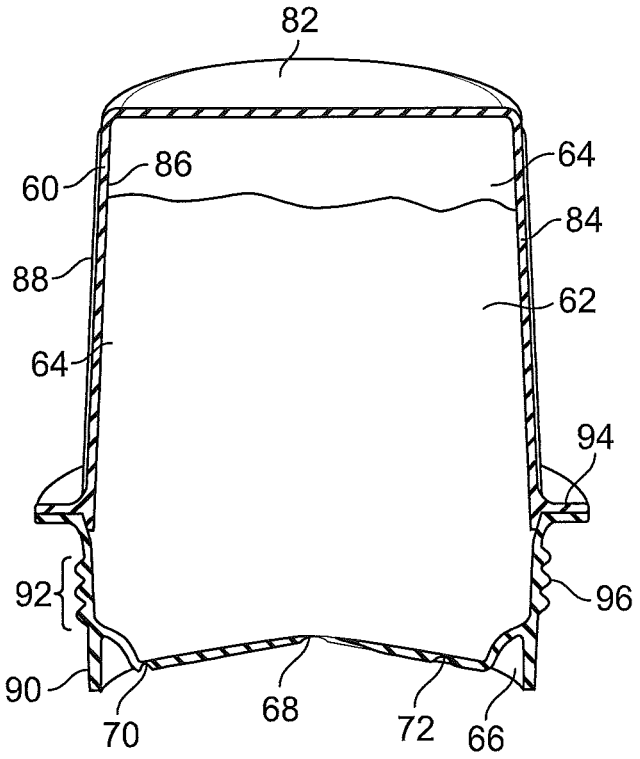
Figure 2E:
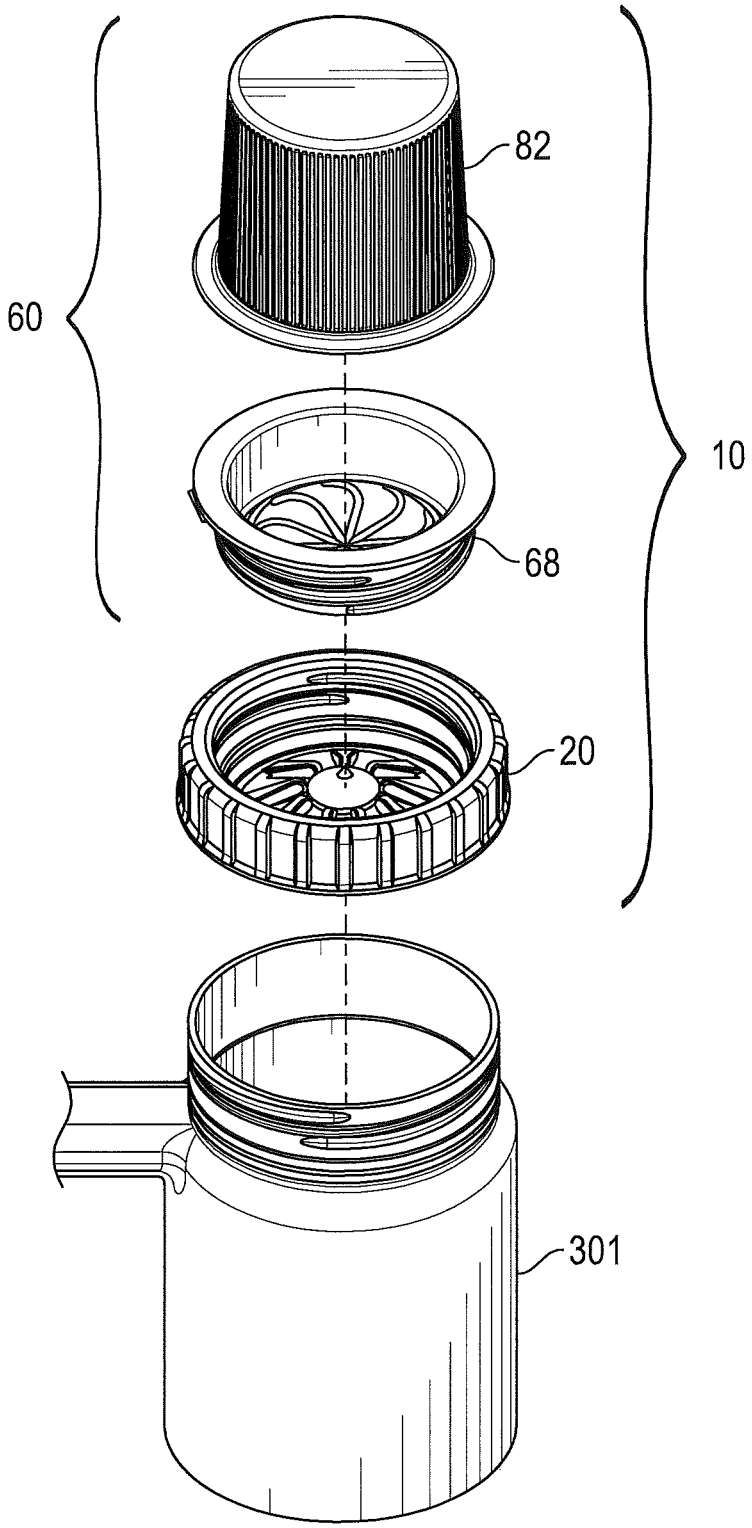

While this invention is susceptible of embodiments in many different forms, there are shown in the drawings and will be described in detail herein specific embodiments with the understanding that the present disclosure is to be considered as an exemplification of the principles of the invention. It is not intended to limit the invention to the specific illustrated embodiments.

The features of the invention disclosed herein in the description, drawings, and claims can be significant, both individually and in any desired combinations, for the operation of the invention in its various embodiments. Features from one embodiment can be used in other embodiments of the invention.

It should be further understood that the title of this section of this specification, namely, "Detailed Description Of The Invention," relates to a requirement of the United States Patent & Trademark Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

Embodiments of the Invention

A dispensing system 10 is generally used to dispense a contained substance 62 into a target container 301. The target container 301 may be empty before the dispensing system 10 is engaged, or may hold more of the contained substance 62 or a different substance.

In illustrated embodiments (FIGS. 1-9), the dispensing system 10 may include a dispensing adaptor 20 and a DCV 60. In some embodiments, the dispensing adaptor 20 may be reversibly and sealably mounted to the target container 301 over the mouth 303 or other opening, to permit a transfer of at least one contained substance 62 into the target container 301. After the contained substance 62 is dispensed into the target container 301, the dispensing system 10 can be removed from the target container 301.

The dispensing system 10 is to be sealably mounted on the target container 301 (a portion of which is illustrated in FIGS. 3C, 4C, 5C, 6C, and 7C) having a mouth 303 defined by a neck 305 or other conventional opening defined by a suitable structure. The dispensing system 10 includes means for securement to a target container 301. For example, the dispensing system 10 may be constructed as essentially cylindrical and may be engaged onto a mouth 303 defined by the target container 301, particularly a bottle, where an internal thread 22 on the dispensing adaptor 20 is provided for screwing onto a complementary external thread 307 of a target container 301, as shown in FIGS. 1C, 2C, 3C, 4C, 5C, 6C, and 7C. Other connecting means, such as a snap-fit bead, for engaging suitable cooperating means, such as a thread, may be used to releasably secure the dispensing system 10 to the target container 301.

As shown in FIGS. 1B, 2B, 2C, 3B, 4B, 5B, 6B, 7B, and 9A-9B, the DCV 60 may contain at least one reservoir 64 for holding a contained substance 62, such as a flowable material like a liquid or particulate solid. Before the dispensing adaptor 20 and DCV 60 are assembled, a substance may be placed within the DCV 60 prior to combining its base 82 and a frangible barrier 68. A bond or other permanent connection may be made connecting the base 82 and the frangible barrier 68 at collar 94, to form the completed DCV 60, with the frangible barrier 68 sealing the contained substance 62 in the reservoir 64 within the DCV 60. After the frangible barrier 68 is added, the contained substance 62 remains confined in the reservoir 64 of the DCV 60, regardless of the DCV's orientation, until the dispensing feature of the dispensing system 10 is engaged, whereupon the contained substance 62 is dispensed from the DCV 60 into the target container 301. In some embodiments, the DCV 60 comprises a plurality of reservoirs, where at least one reservoir holds the contained substance 62, and the other reservoirs may contain the same or different substances or be empty.

The frangible barrier 68 prevents the contents of the DCV 60 from leaving the DCV 60 until desired. The frangible barrier 68 may include an outer edge 70 and have a plurality of tearing paths 72 in the barrier 68, lines or areas of substantially lesser thickness or greater weakness than the rest of the barrier 68. The tearing paths may be, for example, molded or scored into the barrier 68, the plurality of tearing paths 72 defining a plurality of flaps 74 in the barrier 68. The tearing paths 72 may introduce areas of lesser resistance to mechanical force that frangibly tear when stress or force is applied against a portion of the frangible barrier 68. The plurality of tearing paths 72 may provide weakened lines in the frangible barrier 68 that break or tear when sufficient force is applied against them.

In some embodiments, the tearing paths 72 may comprise straight lines. In some embodiments, the tearing paths 72 may comprise curvilinear lines. In some embodiments, the tearing paths 72 may span from one edge of the frangible barrier 68 to another edge of the frangible barrier 68. In some embodiments, the tearing paths 72 may touch one edge of the barrier 68; in others, the tearing paths 72 may not touch the edge of the barrier 68. There is preferably at least one tearing path; more preferably, there are 1-10 tearing paths in some embodiments.

Figure 8:
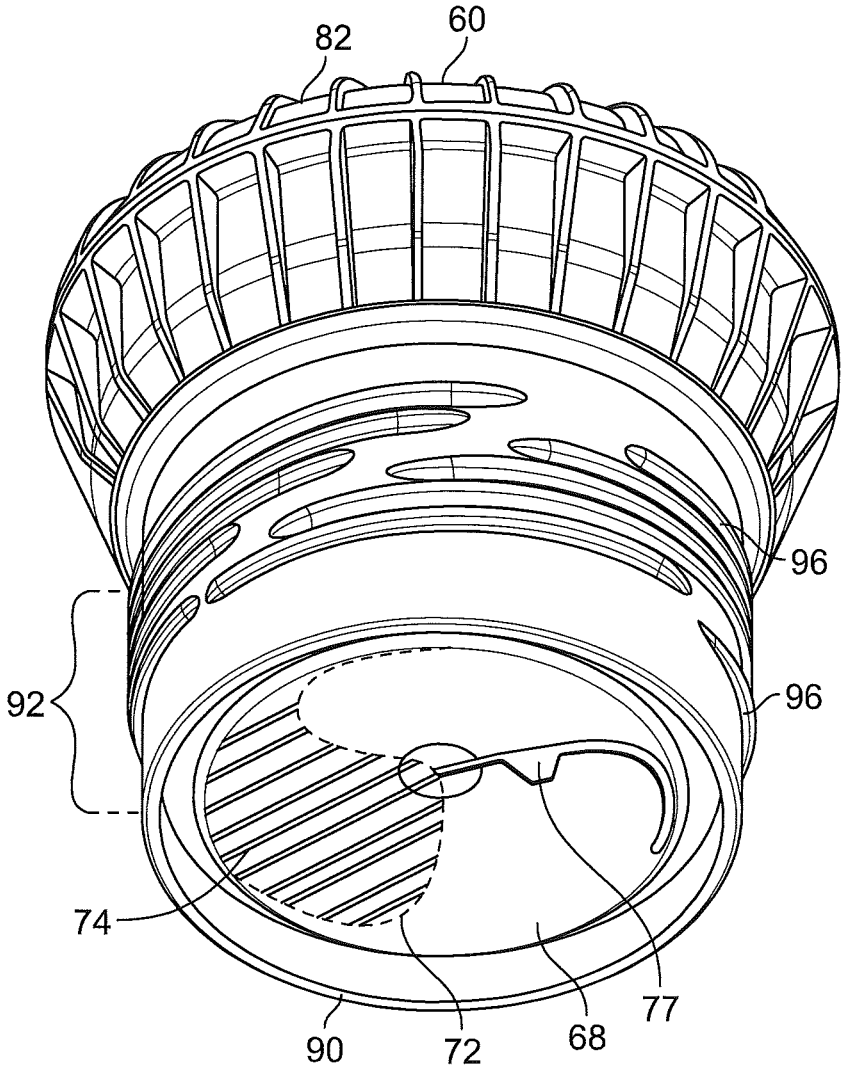
FIG. 8 shows an external view of an alternate embodiment of a DCV.

In some embodiments, the plurality of tearing paths 72 may further comprise at least one protrusion 77 that faces the plurality of spaced-apart wings 44 of the dispensing adaptor 20 (FIG. 8). Such a protrusion 77 may increase the amount of mechanical action against the frangible barrier 68 as the DCV 60 is engaged with the dispensing adaptor 20 and facilitate the release of the contained substance 62 into the target container 301.

The DCV 60 can also include a base 82, a peripheral wall 84 with an interior surface 86 and an exterior surface 88, and a resilient peripheral edge 90 for sealing the DCV 60 to the dispensing adaptor 20 or the target container 301. The peripheral wall 84 of the DCV 60 may include a connecting portion 92, which sealably attaches the DCV 60 to the dispensing adaptor 20, allowing the DCV 60 to be sealably connected to the dispensing adaptor 20. The DCV 60 can also have a collar 94 on its exterior surface 88, which can be located between the base 82 and the opening 66.

The DCV 60 may be made of an elastomeric polymer, such as, for example, polyethylene or polypropylene.

The DCV 60 or dispensing adaptor 20 may further include at least one vent to allow air to exit the target container 301 when the dispensing system 10 is engaged with the target container 301, particularly when stress or force is applied to cause the release of the contained substance 62 from the DCV 60 of the dispensing system 10. Such a vent, which may have a plug, would also allow air intake to relieve an internal vacuum that may be present in the target container 301 during typical use.

It will be understood that the DCV 60 of this invention may be manufactured, stored, transported, processed, used, and sold in an orientation other than the positions described herein.

As shown in FIGS. 1A, 2A, 3A, 4A, 5A, 6A, and 7A, the dispensing adaptor 20 may include a mounting portion 24 to secure the dispensing adaptor 20 to the target container 301. The mounting portion 24 of dispensing adaptor 20 is for sealably communicating with the mouth 303 of the target container 301, the mounting portion 24 having an inner wall 32 with a shoulder 34 and a channel 36, an outer wall 26, and an upper edge 38 for reversibly sealing against the mouth 303 of the target container 301.

In some embodiments, the mounting portion 24 may include an outer wall 26 with a skirt 28, and a suitable means for connection, such as an interior thread 30, for engaging suitable corresponding connecting means on the target container 301, such as an external thread 307, to sealably and releasably secure the dispensing adaptor 20 to the target container 301. Other suitable connecting means include, but are not limited to, other thread configurations, snap-fit beads, or other snap-on or bayonet-type mounting means.

As shown in FIGS. 1A, 2A, 3A, 4A, 5A, 6A, and 7A, the dispensing adaptor 20 may include an aperture 40 through which the contents of the containers (10, 301) may pass. The dispensing adaptor 20 may include a connecting means for sealably communicating with the DCV 60, such as an inner wall 32 with a shoulder 34 and a channel 36 surrounding an outer periphery 42 of the aperture 40 and an upper edge 38 spanning the inner wall 32 and outer wall 26.

In some embodiments, the peripheral wall 84 of the DCV 60 may have exterior threads 96 on its exterior surface 88 for engaging suitable cooperating connecting threads on a corresponding connecting portion 54 of the dispensing adaptor 20 in order to secure the DCV 60 to the dispensing adaptor 20. In some embodiments, the peripheral wall 84 of the DCV 60 may have interior threads 30 on its interior surface 86 as its connecting portion 92 for engaging suitable cooperating threads on the exterior of the corresponding connecting portion 54 of the dispensing adaptor 20 in order to secure the DCV 60 to the dispensing adaptor 20 (not shown). In preferred embodiments, the DCV 60 may be releasably connected to the dispensing adaptor 20 by a rotational movement.

In some embodiments, the connecting portion 54 of the dispensing adaptor 20 includes at least one thread, the connecting portion 92 of the DCV 60 includes at least one thread, and the at least one thread of the dispensing adaptor 20 may engage the at least one thread of the DCV 60. When engaged, the dispensing system 10 may reduce the potential of migration of materials into the threads of the DCV 60 and dispensing adaptor 20.

The dispensing adaptor 20 can also include a plurality of spaced-apart wings 44 projecting inwardly from the outer periphery 42 of the aperture 40 to a central portion 46 (FIGS. 1A, 2A, 3A, 4A, 5A, 6A, and 7A). In some embodiments, the spaced-apart wings are spaced evenly apart. In some embodiments, the plurality of spaced-apart wings 44 comprises at least two wings. In some embodiments, the plurality of spaced-apart wings 44 comprises at least nine wings. In some embodiments, the spaced-apart wings 44 do not touch each other. In some embodiments, the spaced-apart wings 44 may be angled upward at 10-80° relative to a plane defined by the aperture 40 of the dispensing adaptor 20. More preferably, may be angled upward at about 30-55°. The spaces between the flaps 74, or vents 80, increase in size when the flaps 74 in the frangible barrier 68 deform when forced against the spaced-apart wings of the dispensing adaptor 20.

In some embodiments, the central portion 46 may have a frustoconical surface 48 that slopes toward the 60 and away from the target container 301. In some preferred embodiments, the central portion 46 may have a frustoconical surface 48 which may further include at least one point 50. In some preferred embodiments, the at least one point 50 may be located in the center of the central portion 46; in some embodiments, the at least one point 50 may be located off-center of the central portion 46.

In some embodiments, the central portion 46 may include multiple points or protrusions.

Figure 3A:
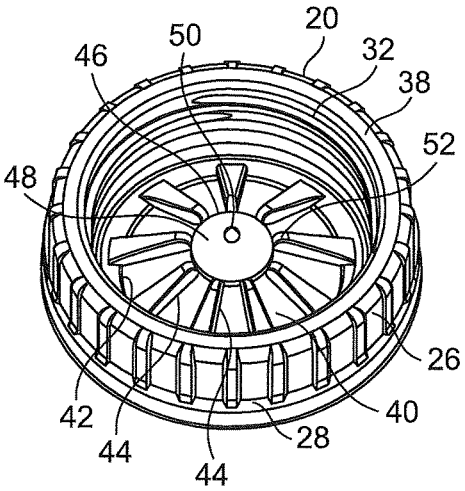
FIGS. 3A-3C shows an external view of a dispensing adaptor, a DCV, and a cross-sectional view of a dispensing system mounted on an exemplary target container in a secure conformation.
Figure 3B:
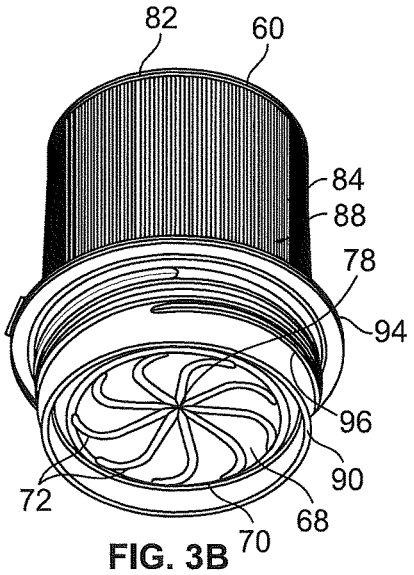
Figure 3C:
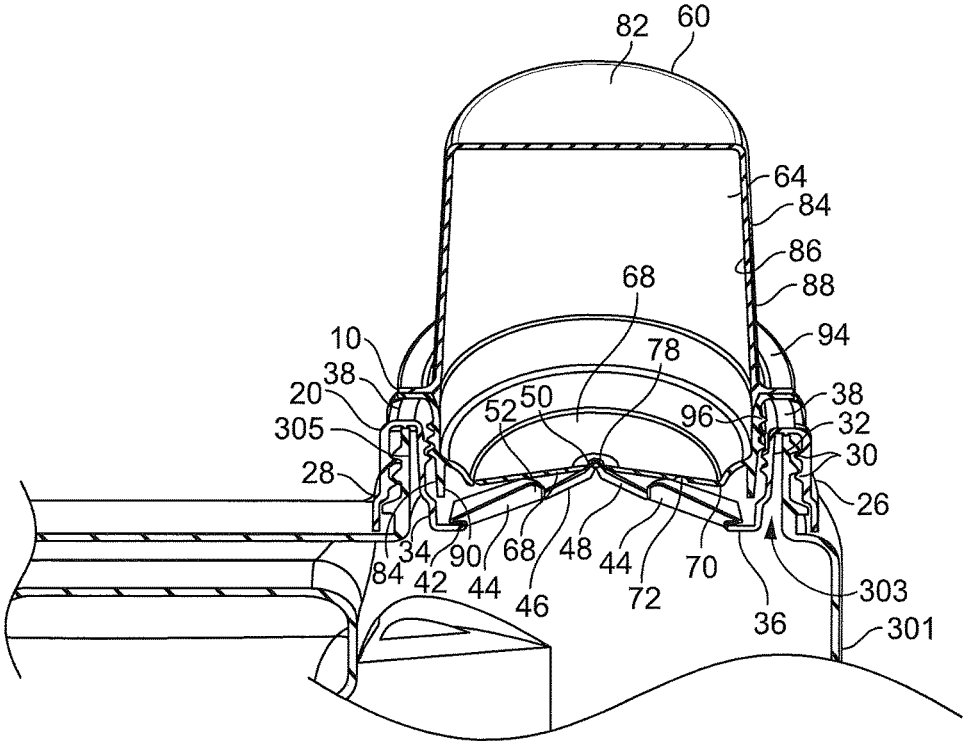
Figure 4A:
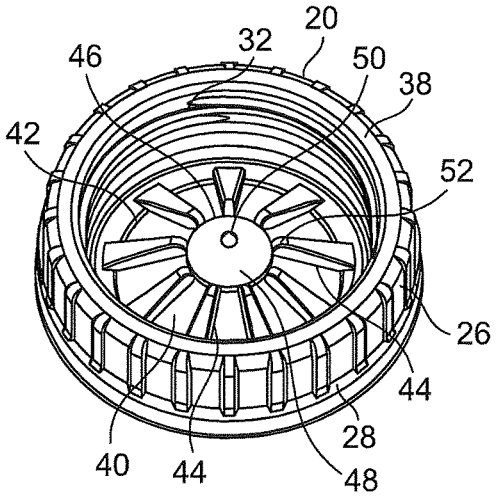
FIGS. 4A-4C shows an external view of a dispensing adaptor, a DCV and a cross-sectional view of a dispensing system mounted on an exemplary target container in a secure conformation.
Figure 4B:
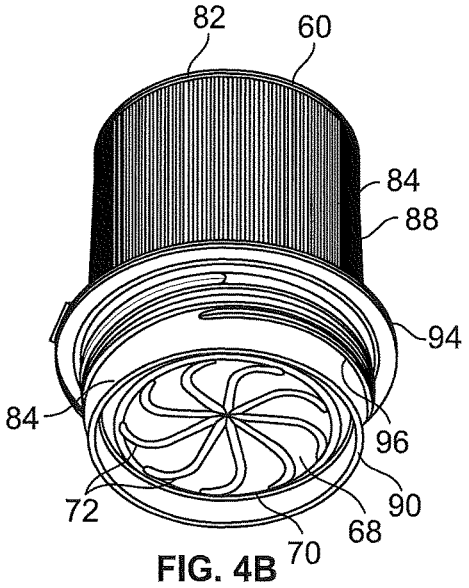
Figure 4C:
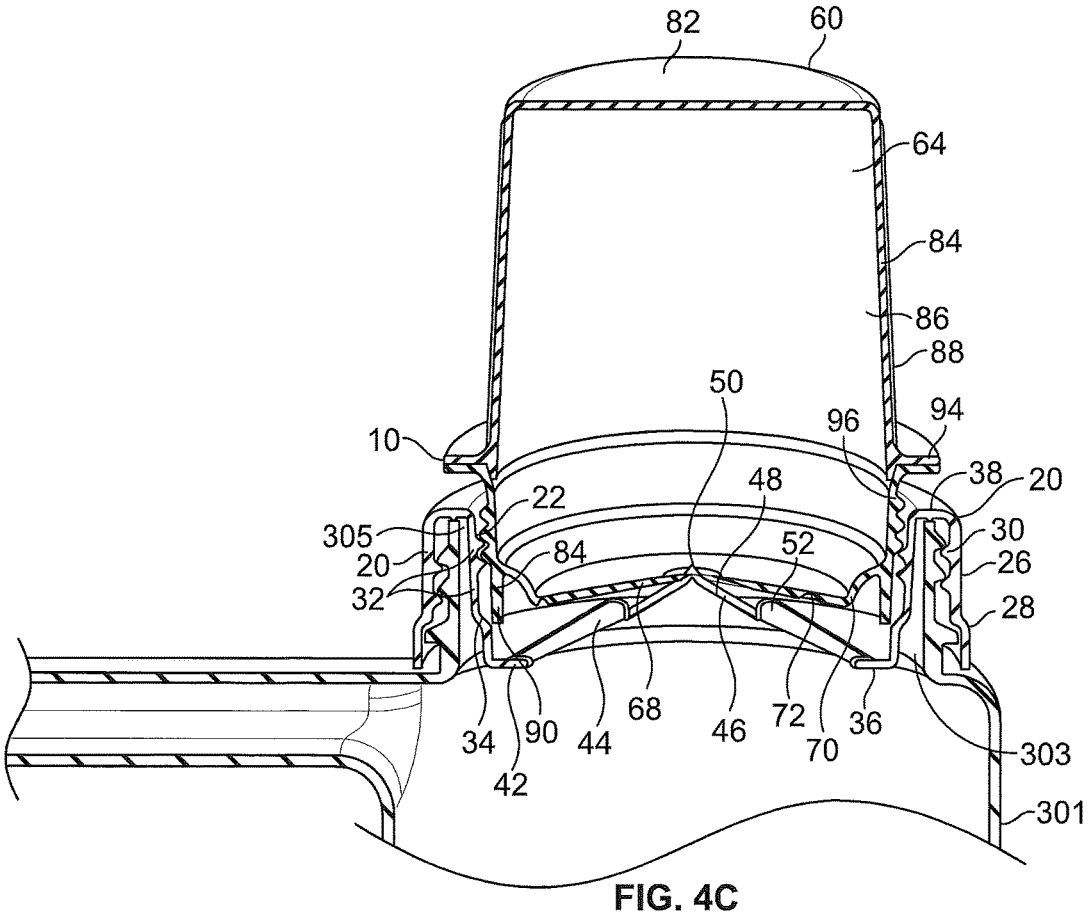
Figure 5A:
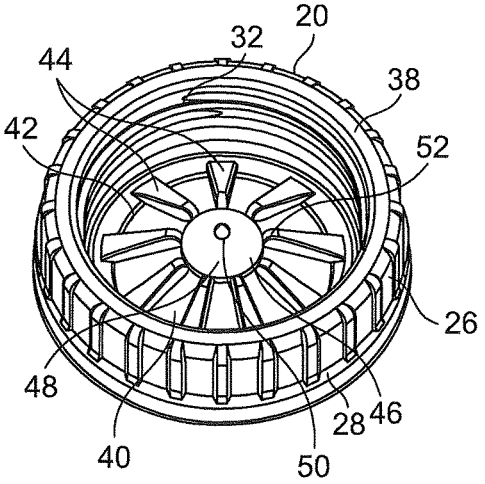
FIGS. 5A-5C shows an external view of a dispensing adaptor, a DCV, and a cross-sectional view of a dispensing system mounted on an exemplary target container in a secure conformation.
Figure 5B:
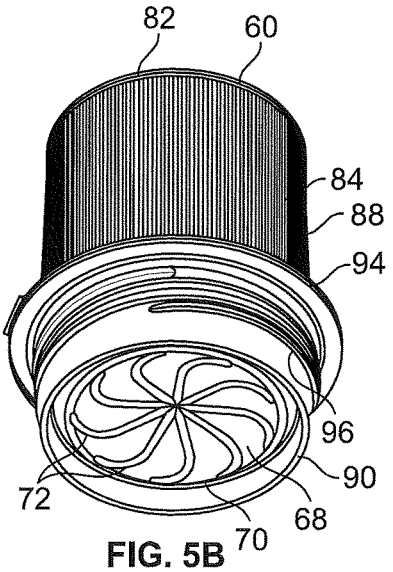
Figure 5C:
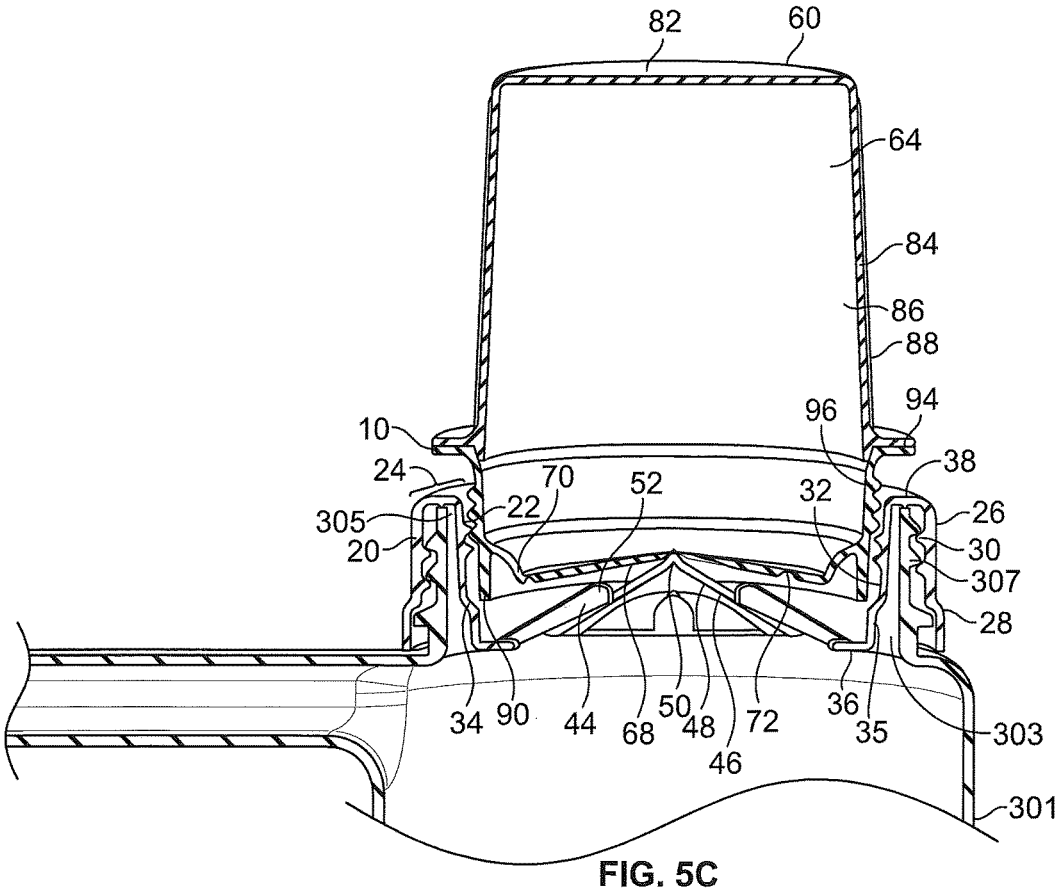
Figure 6A:
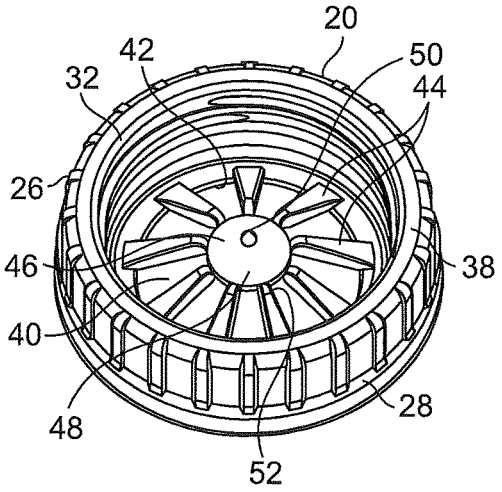
FIGS. 6A-6C shows an external view of a dispensing adaptor, a DCV, and a cross-sectional view of a dispensing mounted on an exemplary target container transitioning from a secure conformation to a dispensing conformation.
Figure 6B:
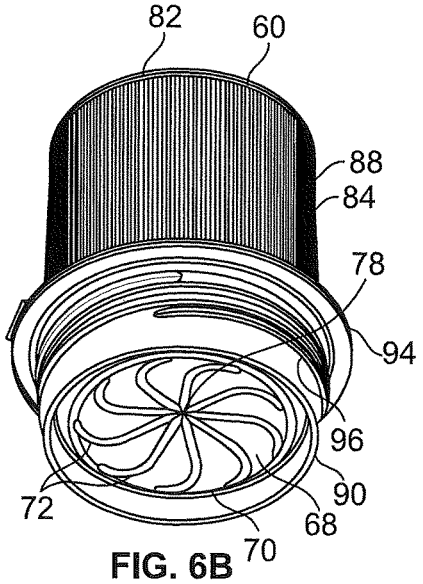
Figure 6C:
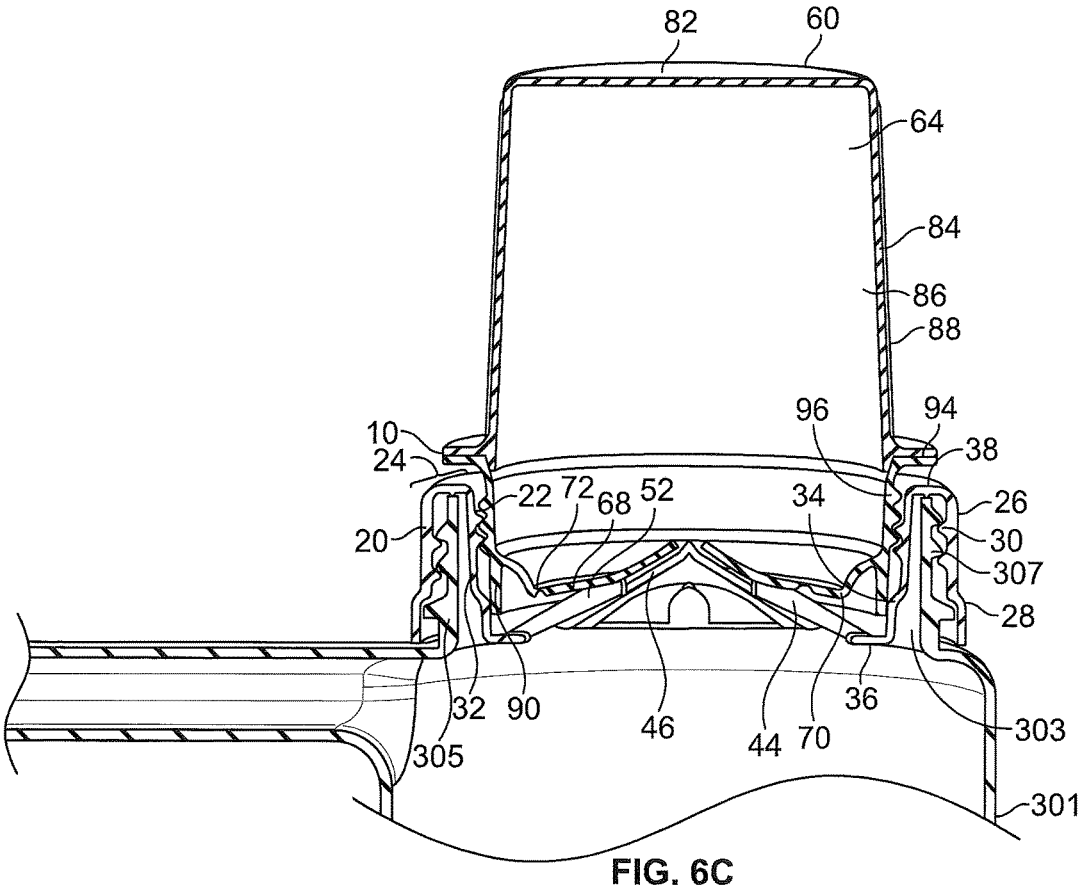

The dispensing system 10 may be mounted to the target container 301 in a secure conformation before the contained substance 62 is dispensed (FIGS. 3C, 4C). The dispensing 10 may include a dispensing adaptor 20 for being reversibly and sealingly mounted to the target container 301 over the mouth 303. The DCV 60 may be assembled before it is engaged with the target container 301. Alternatively, the dispensing adaptor 20 may be mounted to the target container 301 before the DCV 60 is engaged.

The resilient peripheral edge 90 of the DCV 60 engages the shoulder 34 and the corresponding wall 35 of the dispensing adaptor 20 in the secure conformation. In the secure conformation, the frangible barrier 68 remains intact and the contained substance 62 remains in the reservoir 64. To dispense the contained substance 62 into the target container 301, the user activates the dispensing system 10 into changing from the secure conformation to the dispensing conformation. The transition between the secure conformation and the dispensing conformation may be accomplished by any conventional means. In preferred embodiments, the transition between the secure conformation and the dispensing conformation is accomplished with a rotational movement applied to the DCV 60 or the dispensing adaptor 20 or both, where the connecting portion 54 of the dispensing adaptor 20 engages the connecting portion 92 of the DCV 60 by a rotational movement. In more preferred embodiments, a single rotational movement is sufficient to activate the dispensing system 10.

The connecting portion 54 of the dispensing adaptor 20 engages the connecting portion 92 of the DCV 60 so that the resilient peripheral edge 90 engages the shoulder 34 in the secure conformation. The transition from the secure conformation to the dispensing conformation places the central portion 46 and the plurality of spaced-apart wings 44 against the frangible barrier 68 to frangibly tear the barrier 68 along the tearing paths, generating the plurality of flaps 74 and forcing the flaps 74 apart, and the resilient peripheral edge 90 may disengage from the shoulder 34 and may sealably engage the channel 36 (FIGS. 3C, 4C, 5C, 6C, and 7C). The connecting portion 54 of the dispensing adaptor 20 engages the connecting portion 92 of the DCV 60 so that the resilient peripheral edge 90 sealably engages the channel 36 in the dispensing conformation.

Figure 7A:
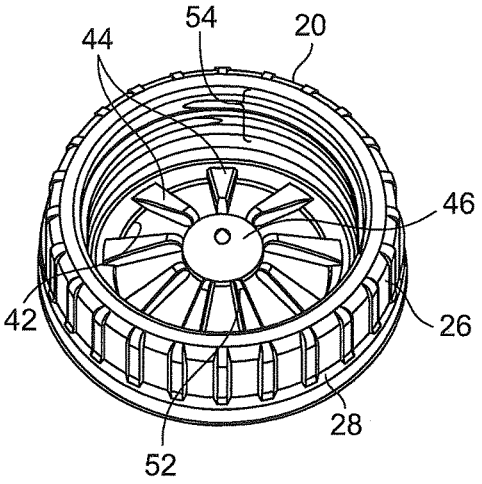
FIGS. 7A-7C shows an external view of a dispensing adaptor, a DCV, and a cross-sectional view of a dispensing mounted on an exemplary target container in a dispensing conformation.
Figure 7B:
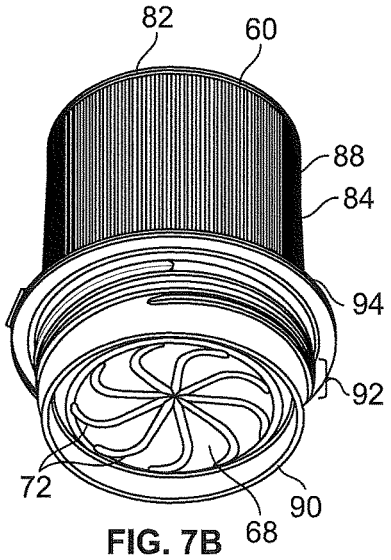
Figure 7C:
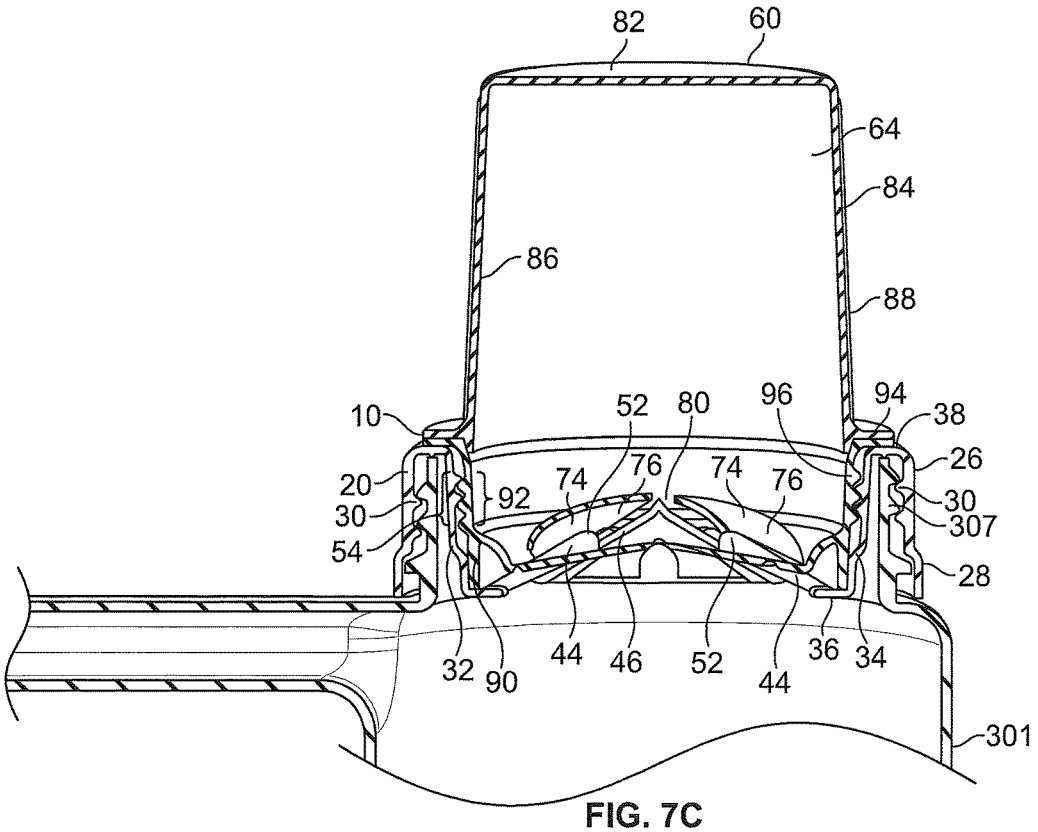

When the dispensing system 10 is activated into a dispensing conformation (FIG. 7C), the resilient peripheral edge 90 may sealably engage the channel 36 of the dispensing adaptor 20. The central portion 46 of the dispensing adaptor 20 is moved to apply force or stress against the frangible barrier 68 of the DCV 60. In some embodiments, the plurality of spaced-apart wings 44 may further include at least one protrusion 52 facing the frangible barrier 68, where the protrusions 52 place supplemental force against the frangible barrier 68 when the dispensing system 10 transitions from the secure conformation (FIGS. 3C, 4C) to the dispensing conformation (FIG. 7C). That is, the protrusions 52 may place additional points of stress against the frangible barrier 68. In some embodiments, the protrusions 52 may increase the amount of mechanical force against the frangible barrier 68 when the DCV 60 is engaged with the dispensing adaptor 20 and facilitate the release of the contained substance 62 into the target container 301.

When the user manipulates the DCV 60 into the dispensing conformation, the central portion 46 and spaced-apart wings of the dispensing adaptor 20 are forced against the frangible barrier 68 of the DCV 60. The frangible barrier 68 is designed to frangibly break along predefined tearing paths, lines or areas of substantially less thickness or greater weakness than the remainder of the frangible barrier 68, when sufficient force is applied, creating a plurality of flaps 74. The relative thinness or weakness of the tearing paths, compared to the rest of the frangible barrier 68, may create areas in the frangible barrier 68 that are susceptible of breaking when force or stress is applied. In some embodiments, the tearing paths meet at a common point 78. In some embodiments, the tearing paths extend from an outer edge 70 of the frangible barrier 68 to a center of the frangible barrier 68. In some embodiments, the tearing paths extend from an outer edge 70 of the frangible barrier 68 to a center of the barrier 68 in straight lines; in some embodiments, the tearing paths extend from an outer edge 70 of the frangible barrier 68 to a center of the frangible barrier 68 in curvilinear lines.

The flaps 74 are forced apart into a bent position when they are forced into contact with the plurality of spaced-apart wings 44. In some embodiments, the flaps 74 may be symmetrical bodies 76 centered around a common point 78. This forced-apart, bent position forces the flaps 74 further apart and may open at least one path for the contained substance 62 to drain from the DCV 60 into the target container 301, and to backwash the contents of the target container 301 into the DCV 60 to flush out any residual traces of the contained substance 62. The transition from the secure conformation to the dispensing conformation places the central portion 46 and the plurality of spaced-apart wings 44 against the frangible barrier 68 to frangibly tear the frangible barrier 68 along the tearing paths, generating the plurality of flaps 74 and forcing the flaps 74 apart. In some embodiments, the tearing paths 72 may generate a plurality of vents 80 in the frangible barrier 68 that are widened when the frangible barrier 68 is forced against the central portion 46 and spaced-apart wings of the dispensing adaptor 20. In some embodiments, the tearing paths 72 may generate a single vent. The transition of from the secure conformation to the dispensing conformation may be generating a plurality of vents 80 and forcing the vents 80 apart, and the resilient peripheral edge 90 may sealably engage the channel 36.

In some embodiments, the plurality of flaps 74 may include as at least one lobe-shaped flap when the tearing paths 72 generate the plurality of vents 80. In some embodiments, the tearing paths 72 may generate at least one vent through which the contained substance 62 may flow (FIG. 8). In some embodiments, the tearing paths 72 may generate more than one vent through which the contained substance 62 may move.

These forced-open flaps 74 or vents 80 create paths through which the contained substance 62 flows out of the DCV 60 through the aperture 40 of the dispensing adaptor 20 into the target container 301. It is a feature of some embodiments that the direction of this flow may be reversible, or directed toward either the target container 301 or the DCV 60. This feature of reversibly altering the direction of the flow of the container contents facilitates a more complete transfer of the contained substance. It can also provide a way to efficiently mix the contents of the containers.

Alternate Embodiments

An alternate embodiment of the invention is shown in FIG. 8. In some embodiments, the dispensing adaptor 20 and the DCV 60 may be manufactured separately and permanently assembled into a single piece, for example, the two pieces may be sonic welded together. In some embodiments, the assembled dispensing system 10 may be engaged onto a mouth 303 defined by the target container 301 by the connecting portion 92. Connecting portion 92, which may include exterior threads 96, may sealably attach the assembled dispensing system 10 to the target container 301. Some embodiments may be shaped like, but not limited to, the one disclosed in FIG. 8, and may provide increased gripability to a user of the invention. That is, an individual may find such embodiment easier to grip and thus, facilitate the attachment or sealing of the assembled dispensing 10 to the target container 301. Such embodiment can also provide a stronger grip of the DCV 60 that also makes an attached and sealed dispensing system 10 easier to unseal and remove from the target container 301. In some embodiments, the dispensing system 10 may be in a shape that improves the gripability to a machine used to engage the dispensing system 10, the DCV 60, and the target container 301.

This method of connection may require minimal force by the user to create at least one breach through which the contained substance 62 stored in the DCV 60 may be dispensed into the target container 301. Moving from secure to dispensing conformations may require as little as a single action from the user and a minimal application of force to take effect. Once the dispensing conformation is achieved, substances can freely flow between the DCV 60 and the target container 301 without further manipulation of the assembly. This conformation also allows a user to transfer the contents of the target container 301 to the DCV 60 and back, in order to flush any residual substances from the DCV 60. There is a need for containers that enable such a transfer of materials.

The dispensing system 10 can be used to transfer a substance into another container, which may be empty or contain its own substance. In a preferred embodiment, the dispensing system 10 can be used to add a substance to the contents of a target container 301. A feature of this embodiment is the reversible flow of materials between the containers when the dispensing feature is engaged. The contents are limited to transfer between the target container 301 and the dispensing system 10, allowing the efficient mixture of the materials. After the initial transfer of a substance into the target container 301, this feature enables the thorough flushing of the DCV 60, to facilitate a more complete delivery of that substance through an aperture of the dispensing adaptor into the target container.

After the contained substance 62 is transferred into the target container 301, the dispensing system 10 can be removed from the target container if desired and when needed.

An additional feature is that, while the dispensing is mounted to the target container, the contents of both devices may be secure from leakage and spillage. An additional feature is that the dispensing system 10 may protect the user and the substances from direct contact with each other at all times during the use of dispensing system 10.

Embodiments of the present invention may be fabricated to accommodate a variety of target containers of different sizes and mouths of different shapes.

Multiple embodiments of the claimed invention may be used to deliver more than one additive, contained substance to a target container at the same time or in separate steps at particular times, or in certain sequences, to enable the making of particular compositions. At least two dispenser assemblies may be used to dispense at least two substances into the same target container.

It may be desirable for a dispensing system 10 to be to allow a user to dispense a contained substance and then flush residual traces of the contained substance from the dispensing by pouring a substance, such as a fluid, liquid, suspension, or other substance, through the dispensing system 10. This feature may be particularly desirable where complete delivery of the contained substance is desired. A flow-through flushing feature can also be desirable to protect a user from contact with a contained substance, which may be caustic, toxic, or otherwise harmful to the user or the external environment. Such a feature can also be useful for removing traces of the contained substance 62 from the dispensing system 10 prior to the disposal of the dispensing system 10.

Figure 9A:
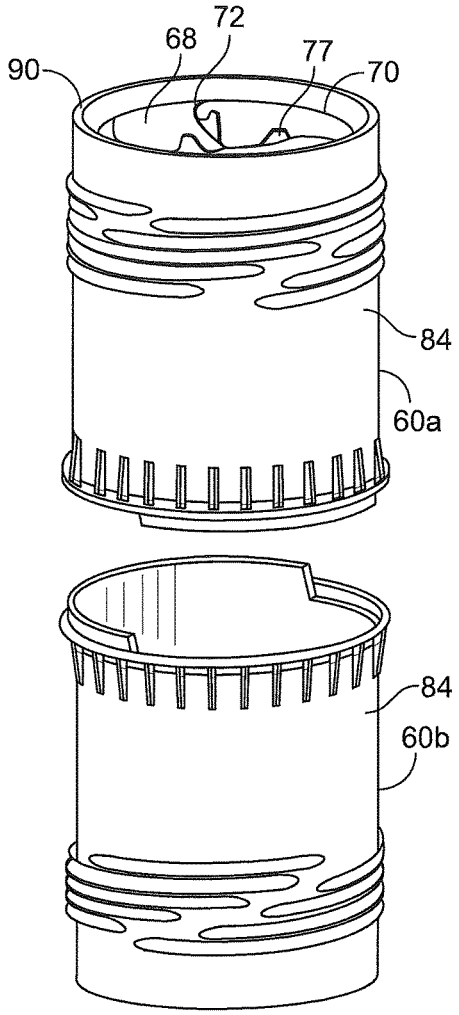
FIGS. 9A-9B show an alternate embodiment where a pair of DCV halves function as a single DCV when combined.
Figure 9B:
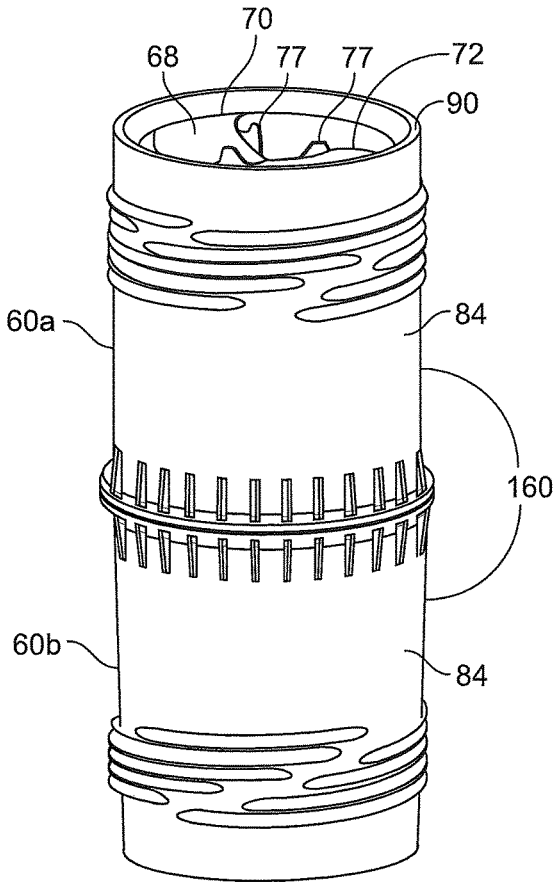

In some embodiments, at least two DCV 60 may be used together to dispense a contained substance 62 in a way to provide a dispensing system 10 with a flow-through flushing capability. FIGS. 9A-9B.

In some embodiments, neither a first DCV 60*a* nor a second DCV 60*b* would include a base 82. In such an embodiment, a frangible barrier 68 may be attached to each DCV 60*a*, 60*b*. At least one contained substance 62 may be placed into the first DCV 60*a*. The second DCV 60*b* may then be connected to the first DCV 60*a*, thus securing the contained substance 62 (FIG. 9B). The first DCV 60*a* and the second DCV 60*b* may attach to each other directly or via a connecting portion between them. In some embodiments, the first and second DCV 60*a*, 60*b* would then be mated into a single piece, a mated pair of DCVs 160, for example by sonic-welding.

The dispensing adaptor 20 may connect to either end of the mated pair of DCVs 160; that is the dispensing adaptor 20 may sealably attach via the connecting portion 92 of the first or second DCV 60*a*, 60*b*. A user may attach the mated pair of DCVs 160 to the dispensing adaptor 20, forming the dispensing system 10; then, the dispensing system 10 may be engaged with the target container 301 to disrupt the frangible barrier 68 of the first DCV 60*a* and dispense the contained substance 62. After the contained substance 62 has been dispensed, the user may remove the mated pair of DCVs 160 from the target container 301, invert the mated pair of DCVs 160, and engage the opposite end of the mated pair of DCVs 160 to the dispensing adaptor 20. Upon disrupting the frangible barrier 68 of the second DCV 60*b*, both ends of the mated pair of DCVs 160 would be unsealed; in this conformation, a user can pour a substance, such as a fluid, liquid, suspension, or other substance, through the dispensing system 10 through an aperture of the dispensing adaptor into the target container.

In some embodiments, the dispensing system 10 includes a first DCV 60*a* and a second DCV 60*b* for being sealably connected to the dispensing adaptor 20, the first DCV 60*a* and second DCV 60*b* each having a connecting portion 54 for sealably communicating with the dispensing adaptor 20, at least one reservoir 64, and a resilient peripheral edge 90 for sealing the DCV 60*a*, 60*b* to the dispensing adaptor 20. Each DCV 60*a*, 60*b* may include a frangible barrier 68 having a plurality of tearing paths 72 defining a plurality of flaps 74 in the barrier 68. The first DCV 60*a* and the second DCV 60*b* may attach into a mated pair of DCVs 160 as a unitary container storing the contained substance 62 with the frangible barriers 68 on opposite ends of the unitary container.

The connecting portion 54 of the dispensing adaptor 20 may engage the connecting portion 54 of the first DCV 60*a* so that the resilient peripheral edge 90 engages the shoulder 34 in a secure conformation, the connecting portion 54 of the dispensing adaptor 20 engaging the connecting portion 92 of the first DCV 60*a* so that the resilient peripheral edge 90 sealably engages the channel 36 in a dispensing conformation, wherein a transition from the secure conformation to the dispensing conformation places the central portion 46 and the plurality of spaced-apart wings 44 against the frangible barrier 68 of the first DCV 60*a* to frangibly tear the frangible barrier 68 along the tearing paths 72, and the resilient peripheral edge 90 sealably engages the channel 36. The connecting portion 54 of the dispensing adaptor 20 may engage the connecting portion 92 of the second DCV 60*b* so that the resilient peripheral edge 90 engages the shoulder 34 in a secure conformation, the connecting portion 54 of the dispensing adaptor 20 engaging the connecting portion 92 of the second DCV 60*b* so that the resilient peripheral edge 90 sealably engages the channel 36 in a dispensing conformation, wherein a transition from the secure conformation to the dispensing conformation places the central portion 46 and the plurality of spaced-apart wings 44 against the barrier 68 of the second DCV 60*b* to frangibly tear the frangible barrier 68 along the tearing paths 72, and the resilient peripheral edge 90 can also sealably engage the channel 36.

Specific embodiments of a dispensing system according to the present invention have been described for the purpose of illustrating the manner in which the invention can be made and used. It should be understood that the implementation of other variations and modifications of this invention and its different aspects will be apparent to one skilled in the art, and that this invention is not limited by the specific embodiments described. It is understood to encompass the present invention and any and all modifications, variations, or equivalents that fall within the spirit and scope of the basic underlying principles disclosed and claimed herein.

What is claimed is:

1. A dispensing system for a mouth defined by a target container, to permit a transfer of at least one contained substance into the target container, the dispensing system comprising:

a dispensing adaptor for being reversibly and sealably mounted to the target container over the mouth, the dispensing adaptor having:

a mounting portion for sealably communicating with the mouth of the target container, the mounting portion having an inner wall with a shoulder and a channel, an outer wall, and an upper edge for reversibly sealing against the mouth of the target container, an aperture, a connecting portion, a plurality of spaced-apart wings projecting inwardly from an outer periphery of the aperture to a central portion, each wing including a protrusion facing a frangible barrier, the protrusion defining an elevated ridge for engaging the frangible barrier; and a dispensable containment vessel for being sealably connected to the dispensing adaptor, the dispensable containment vessel having:

a connecting portion for sealably communicating with the dispensing adaptor, at least one reservoir for holding the contained substance, a resilient peripheral edge for sealing the dispensable containment vessel to the dispensing adaptor, and the frangible barrier sealing the contained substance within the reservoir and having a plurality of tearing paths defining a plurality of flaps in the frangible barrier, wherein the tearing paths include curvilinear lines;

the connecting portion of the dispensing adaptor for engaging the connecting portion of the dispensable containment vessel so that the resilient peripheral edge engages the shoulder in a secure conformation;

the connecting portion of the dispensing adaptor engaging the connecting portion of the dispensable containment vessel so that the resilient peripheral edge engages the channel in a dispensing conformation;

wherein a transition from the secure conformation to the dispensing conformation places the protrusions on the plurality of spaced-apart wings against the barrier to frangibly tear the barrier along the tearing paths, generating the plurality of flaps and forcing the flaps apart, and the resilient peripheral edge engages the channel.

2. The dispensing system as in claim 1 in which the plurality of spaced-apart wings comprises at least two wings.

3. The dispensing system as in claim 2 wherein, during the transition to the dispensing conformation, the central portion and the protrusions of each wing are placed against the frangible barrier.

4. The dispensing system as in claim 2 in which the plurality of spaced-apart wings are spaced evenly apart.

5. The dispensing system as in claim 1 in which the plurality of spaced-apart wings are angled upward at 10-80° relative to a plane defined by the aperture.

6. The dispensing system as in claim 1 in which the central portion comprises a frustoconical surface that slopes toward the dispensable containment vessel.

7. The dispensing system as in claim 6 wherein the frustoconical surface further includes at least one point.

8. The dispensing system as in claim 7 wherein the point is located off-center of the central portion.

9. The dispensing system as in claim 1 in which the plurality of flaps includes are lobe-shaped.

10. The dispensing system as in claim 1 in which the plurality of flaps includes at least one lobe-shaped flap.

11. The dispensing system as in claim 1 wherein, during the transition to the dispensing conformation, the central portion applies force against the frangible barrier.

12. The dispensing system as in claim 11 wherein, during the transition to the dispensing conformation, the protrusions apply supplemental force against the frangible barrier.

13. The dispensing system as in claim 1 in which the tearing paths extend to a center of the barrier in curvilinear lines.

14. A dispensing system as in claim 1 wherein the DCV comprises a plurality of reservoirs, wherein at least one reservoir holds the contained substance.

15. A dispensing system for a mouth defined by a target container, to permit a transfer of at least one contained substance into the target container, the dispensing system comprising:

a dispensing adaptor for being reversibly and sealably mounted to the target container over the mouth, the dispensing adaptor having:

a mounting portion for sealably communicating with the mouth of the target container, the mounting portion having an inner wall with a shoulder and a channel, an outer wall, and an upper edge for reversibly sealing against the mouth of the target container, an aperture, a connecting portion, a plurality of spaced-apart wings projecting inwardly from an outer periphery of the aperture to a central portion, each wing including a protrusion facing a frangible barrier; and a dispensable containment vessel for being sealably connected to the dispensing adaptor, the dispensable containment vessel having:

a connecting portion for sealably communicating with the dispensing adaptor, at least one reservoir for holding the contained substance, a resilient peripheral edge for sealing the dispensable containment vessel to the dispensing adaptor, and the frangible barrier sealing the contained substance within the reservoir and having a plurality of tearing paths defining a plurality of flaps in the frangible barrier;

the connecting portion of the dispensing adaptor for engaging the connecting portion of the dispensable containment vessel so that the resilient peripheral edge engages the shoulder in a secure conformation;

the connecting portion of the dispensing adaptor engaging the connecting portion of the dispensable containment vessel so that the resilient peripheral edge engages the channel in a dispensing conformation;

wherein a transition from the secure conformation to the dispensing conformation places the protrusions on the plurality of spaced-apart wings against the barrier to frangibly tear the barrier along the tearing paths, generating the plurality of flaps and forcing the flaps apart, and the resilient peripheral edge engages the channel; and wherein the connecting portion of the dispensing adaptor engages the connecting portion of the dispensable containment vessel by a rotational movement.

16. The dispensing system as in claim 15 wherein:

the connecting portion of the dispensing adaptor further comprises at least one thread;

the connecting portion of the dispensable containment vessel further comprises at least one thread; and the at least one thread of the dispensing adaptor engages the at least one thread of the dispensable containment vessel.

17. A dispensing system for a container, the dispensing system comprising:

a dispensing adaptor having:

a mounting portion, an aperture, a connecting portion, a plurality of spaced-apart wings projecting inwardly from an outer periphery of the aperture to a central portion defining a tip extending toward a frangible barrier, each of the wings defining an elevated ridge extending toward the frangible barrier; and a dispensable containment vessel having:

a connecting portion, at least one reservoir, a resilient peripheral edge, and the frangible barrier sealing the reservoir, and having a plurality of curvilinear tearing paths in the frangible barrier;

wherein in a transition from a sealed conformation to a dispensing conformation, the elevated ridges and the central portion tip engage and frangibly tear the frangible barrier along the curvilinear tearing paths, generating and forcing apart a plurality of vents.

18. The dispensing system as in claim 17, wherein in the transition from the secure conformation to the dispensing conformation, the elevated ridges and the central portion tip generate a plurality of flaps and force the flaps apart.

19. The dispensing system as in claim 17, wherein during the transition from the secure conformation to the dispensing conformation, at least one elevated ridge contacts at least one tearing path.

20. A dispensing system for a container, the dispensing system comprising:

a dispensing adaptor having:

a mounting portion, an aperture, a connecting portion for engaging a connecting portion of a dispensable containment vessel by a rotational movement;

a plurality of spaced-apart wings projecting inwardly from an outer periphery of the aperture to a central portion, each of the wings and the central portion defining a tip extending toward a frangible barrier, and each of the wings defining an elevated ridge extending toward the frangible barrier; and a dispensable containment vessel having:

the connecting portion, at least one reservoir, a resilient peripheral edge, and the frangible barrier sealing the reservoir, and having a plurality of tearing paths in the frangible barrier;

wherein in a transition from a secure conformation to a dispensing confrontation, the elevated ridges and the central portion tip frangibly tear the frangible barrier along the tearing paths, generating and forcing apart a plurality of vents.

21. The dispensing system as in claim 20, wherein the transition from the secure conformation to the dispensing conformation, the wing tips and the central portion tip generate a plurality of flaps and force the flaps apart.

22. The dispensing system as in claim 20, wherein during the transition from the secure conformation to the dispensing conformation, at least one wing tip contacts at least one the tearing path.

* * * * *